United States Patent [19]

Chieng

[11] Patent Number: 4,749,923

[45] Date of Patent: Jun. 7, 1988

[54] ELECTRIC SEWING MACHINE MOTOR CONTROL DEVICE

[75] Inventor: Yu S. Chieng, Taichung, Taiwan

[73] Assignee: Yong Huei Hsing Electric Industries Corp., Taichung, Taiwan

[21] Appl. No.: 38,183

[22] Filed: Apr. 14, 1987

[51] Int. Cl.[4] ..... H02P 3/10

[52] U.S. Cl. ..... 318/269; 318/254; 318/275; 318/374

[58] Field of Search ..... 318/138, 254, 369, 439, 318/561, 685, 269, 275, 373, 374

[56] References Cited

U.S. PATENT DOCUMENTS

| | | | |
|---|---|---|---|
| 4,473,786 | 9/1984 | Miyashita et al. | 318/561 |
| 4,513,676 | 4/1985 | Martell et al. | 318/369 X |
| 4,516,514 | 5/1985 | Neki et al. | 318/369 X |
| 4,549,120 | 10/1985 | Banno et al. | 318/373 X |
| 4,558,265 | 12/1985 | Hayashida et al. | 318/561 |
| 4,618,808 | 10/1986 | Ish-Shalom et al. | 318/685 X |
| 4,629,949 | 12/1986 | Senso | 318/374 X |
| 4,692,676 | 9/1987 | Dohi et al. | 318/254 X |

*Primary Examiner*—Bentsu Ro

*Attorney, Agent, or Firm*—Klein & Vibber

[57] ABSTRACT

A motor control device provided on an electric sewing machine comprising a brushless permanent-magnet motor and in combination with a magnetic pole sensor, rotational-speed and rotational-speed polarity detector for sewing machine, detectors for needle-position and needle positioning signal, and the control systems of speed and needle stagnation thereof; with the specific ways of controlling the needle stagnant position and the strength of the reverse current for braking the motor, simple structure, less power wastage and no wearable friction clutch and brake device are needed, a quick sewing machine starting, quick stabilizing of speed control and precise stagnation of the sewing needle at a preset position can be achieved.

9 Claims, 8 Drawing Sheets

ELECTRIC SEWING MACHINE MOTOR CONTROL DEVICE

BACKGROUND OF THE INVENTION

This invention relates generally to a motor control device of an electric sewing machine motor and more particularly to a control device of this type which, in the process of stopping the sewing machine, can accurately stop the sewing needle at a predetermined stagnant position.

Referring first to FIG. 9, there is shown a structure of conventional sewing machine which comprises of a sewing head portion 1, a detector unit 2 for detecting the rotational speed of sewing machine and the position of the needle, a driving motor 3, a control unit 4, and a control pedal 5, wherein the power supply of the sewing machine is shown in FIG. 10. A flying wheel 3A within the motor 3 is driven in a constant revolution. When the coil of the electromagnetic clutch 3B is supplied with exciting current of various strength, through frictional coupling or eddy-current coupling mechanism, the torque of the flying wheel 3A is proportionally transmitted to the driven shaft 3C. The stopping action of the sewing machine is performed by the friction brake 3D. When the sewing machine is stopped, the rotation of the electrical motor is still maintained. As a result, great amount of electrical energy is wasted. On the other hand, the inductance of the coil of the clutch 3B is large, and there will be time delay in response at the instanct when the current through the coil is cut off or turned on. Moreover, with the mechanical reciprocating operation of the clutch, the response time of the whole system is further increased. Therefore, this will result in an unstable speed control, poor response and inexact stagnation position of the needle.

The durability of the friction clutch 3B and the friction brake 3D is increased by using friction disc made of soft wood coated with anti-wear material. However, the sewing machine usually operates at a moderate speed, i.e., there is difference in rotational speed between the flying wheel 3A and the clutch 3B, as a result, the wearing of soft wood will increase the gap between the contact surface and the soft wood (the gap distance should be kept within 0.3–0.5 mm). This effect results in the increase of the response time, and the control system will be more unstable. Particularly, for the case of the friction brake, both the delay of exciting current and the increase of gap distance will retard the braking process, and then increase and change the braking distance of the needle. These effects will degrade the precision of the positioned stagnation of the needle.

If the eddy-current clutch is employed, contact between transmission shafts can be avoided and the durability is thus increased, however, due to the low efficiency, the exciting current must be increased which may result in overheat or significant deformation in some parts of the clutch. The driving motor not only comprises a main body, but also includes a flying wheel, a friction or eddy-current clutch, a friction brake, thus the machine is rather awkward, and due to the co-axial rotation, it is necessary that each gap be accurately adjusted, thus the cost and quality of the product are affected.

In order to mitigate the above-mentioned drawbacks, it is proposed that conventional DC permanent magnetic (PM) motor or brushless motor is employed. However, the frequent on and off operation of the sewing machine will damage the brush of the DC PM motor, which thus increases the cost of operation. When employing the brushless motor in sewing machine, an electronic motor control device must be employed to achieve a stable speed control and stop the needle at a present stagnation.

The speed control of a DC motor is performed by controlling the mean current flow through the stator winding of the motor. The greater the mean current is, the higher the speed is. If the speed is to be reduced, current with reverse direction is applied, and the greater the reverse current is the greater the retarding torque is.

In order to stagnate the needle at a specific preset position, the control device is provided with a needle-positioning signal detector which will send out a needle positioning signal at the moment when the needle reaches a specific preset position, and at this moment the control device starts the braking process and supplies a reverse braking current until the needle is completely stopped. In the conventional design, one of the key points is to determine the exact end point of the braking process and still keep the braking distance can be pre-compensated and precisely adjusted. In the prior art, different control mechanisms of the braking process have been suggested, but an accurate positioned stagnation of the needle still cannot be achieved. Some of factors making this trouble are the drift of the DC (direct current) level of the speed detector due to the variation of the ambient temperature, and the dependance of the braking distance on the instantaneous speed of the motor at the moment when the braking process just begins, which is varied with the working condition of the sewing machine (the low speed range is within 120–240 RPM) and generally not a constant.

SUMMARY OF THE INVENTION

In view of the forgoing, the main object of this invention is to provide a motor control device wherein the time delay of the control system can be reduced and the speed control can be stabilized and an accurate positioned stagnation of the needle can be achieved.

It is another object of this invention to provide a motor control device such that the needle of the sewing machine is stopped at a predetermined position which will not be affected by the ambient temperature and the DC level drift of the speed detector.

Yet another object of this invention is to provide a motor control device which achieves a precise positioned stagnation of the sewing needle and keeps the braking distance a constant which will not be varied with the initial speed of the sewing machine in the braking process and thus can be precisely precompensated.

According to this invention, the end point of the braking process, which is the moment to cut off the reverse current producing the brake torque, is detected when the sign of the rotation-direction signal is changed from positive to negative.

Another detection method of the end point of the braking process, in accordance with this invention, is to detect the very moment that the polarity of the output signal of the rotational-speed and rotational-speed polarity detector changes.

In accordance with this invention, the ratio of the reverse current strength producing the brake torque to the square of the instantaneous rotational speed of the motor at the moment that it starts to be braked is kept constant. With the strength of the reverse braking current set by said specific relationship, analysis of the rotational dynamics shows that the braking distance, i.e., the angular displacement between the position where the needle-positioning signal is detected and the position where the needle is complete stopped, is a constant and smaller than 3 degrees.

In this invention, due to the strict relationship between the strength of the reverse braking current and the initial speed of the sewing machine in the braking process, the sewing machine can hence be completely stagnated exactly at a fixed braking distance. As a result, an accurate stagnant position of the needle can be obtained.

Other objects and advantages of the invention will become more apparent from a study of the following description taken with the accompanying drawings.

DETAILED DESCRIPTION OF THE PREFERRED EMBODIMENT

Figure 1:
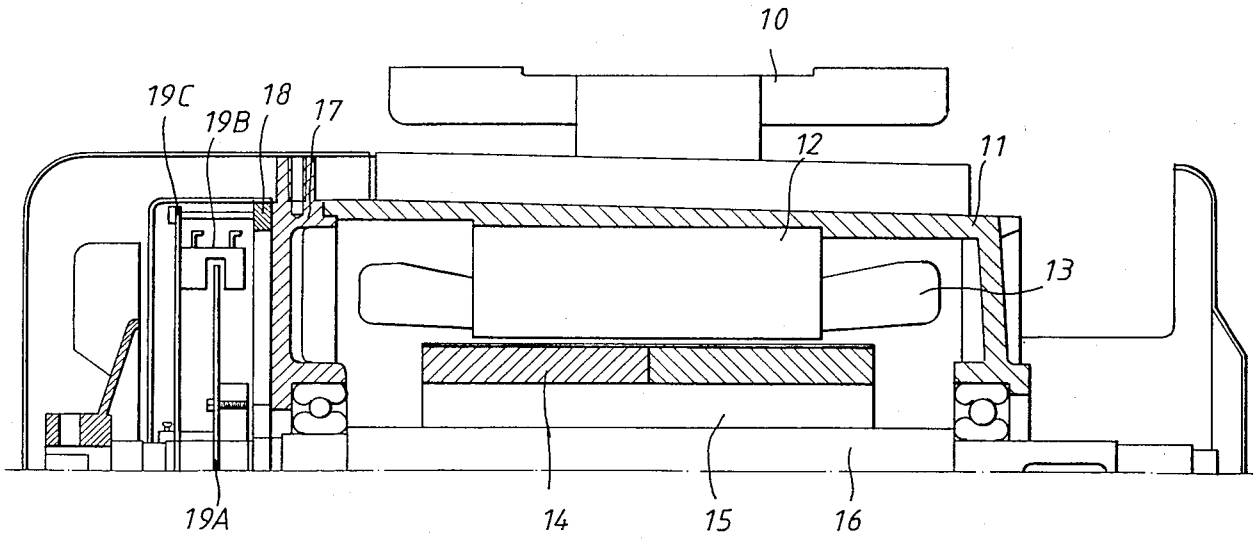
FIG. 1 is a cross-sectional view of the driving motor according to the present invention.

Referring to FIG. 1, it can be seen that a supporting plate with which the driving motor is attached to the sewing table is represented by reference numeral 10, the housing of the driving motor is represented by 11, the stator is represented by 12, the stator windings are represented by 13, the permanent-magnet rotor mounted on the rotor collar 15 is represented by 14, the rotor shaft is represented by 16, the bracket is represented by 17, and the circuitboard positioning bracket is represented by 18. The sensor baseboard 19A and, the permanent-magnet-rotor-position detector (PMRP dectector) 19B which is positioned on the circuit board 19C constitute a commutation sensor.

Figure 2:
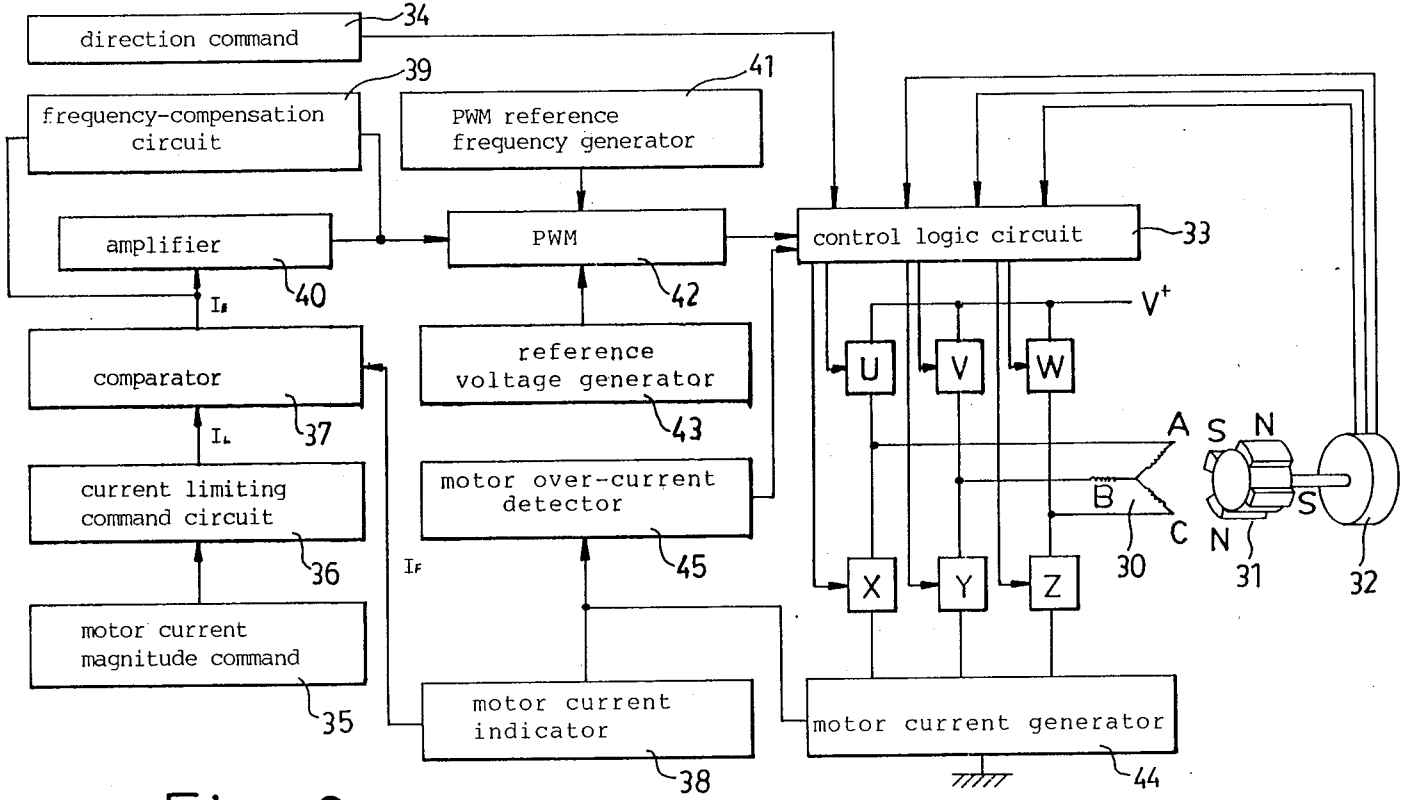
FIG. 2 is the block diagram of the control logic and the pluse width modulator (PWM) of the control motor.

FIG. 2 shows the circuits of motor control logic and pulse width modulator (PWM) drive system, wherein the stator windings of three-phase type are represented by 30, the permanent-magnet rotor is represented by 31, and the detector of the position of the permanent-magnet rotor is represented by 32. The control logic circuit 33 receives the position signal from PMRP detector 32, and, then controls the conducting sequence of power transistors U, V, W, X, Y and Z. The output terminals of power transistors are connected to stator windings A, B, and C. The direction command and the motor current magnitude command sent from the microprocessor are represented by 34 and 35, respectively. The current limiting command circuit is represented by 36. The comparator is represented by 37. The motor-current indicator is represented by 38. The frequency-compensation circuit is represented by 39. The amplifier is represented by 40. The PWM reference frequency generator is represented by 41. The PWM is represented by 42. The reference voltage generator is represented 43. The motor current detector is represented by 44. The motor over-current detector is represented by 45. The PWM 42 operates at a fixed reference frequency FM whose pulse-width is determined by the output error signal IE of the comparator 37 with the motor feedback current IF as one of its input. The other input signal of the comparator 37 is the current limiting command IL sent from the current limiting command circuit 36. The frequency-compensation circuit 39 can be designed in accordance with the characteristics of the system so as to achieve an optimum stability.

Figure 3:
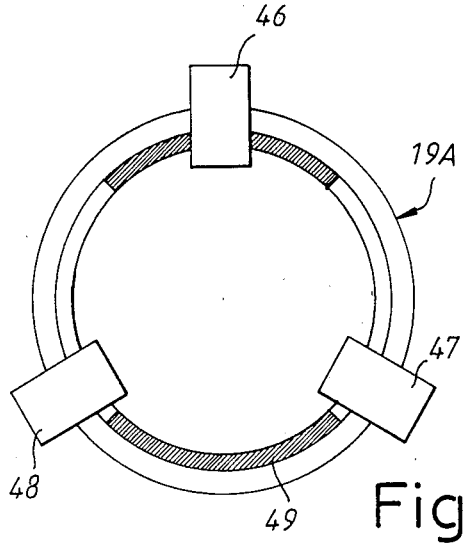
FIG. 3 and FIG. 4 show the motor magnetic-pole sensor and its output time diagram, respectively.
Figure 4:
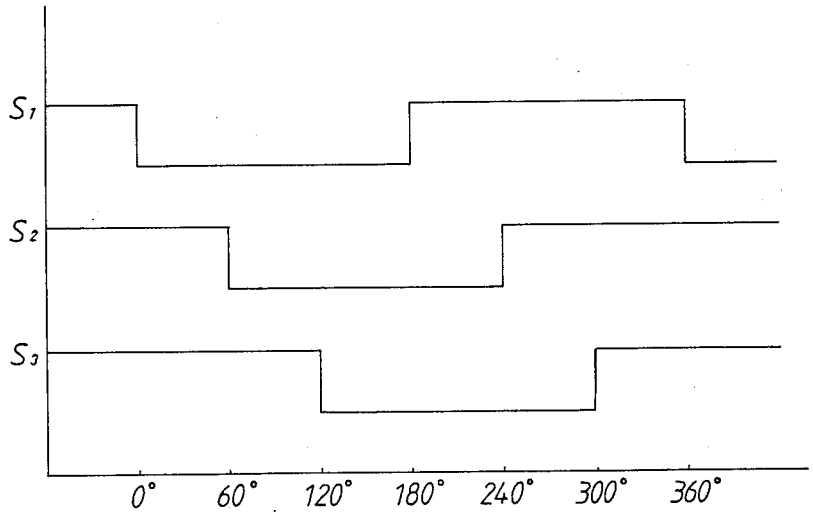
Figure 5:
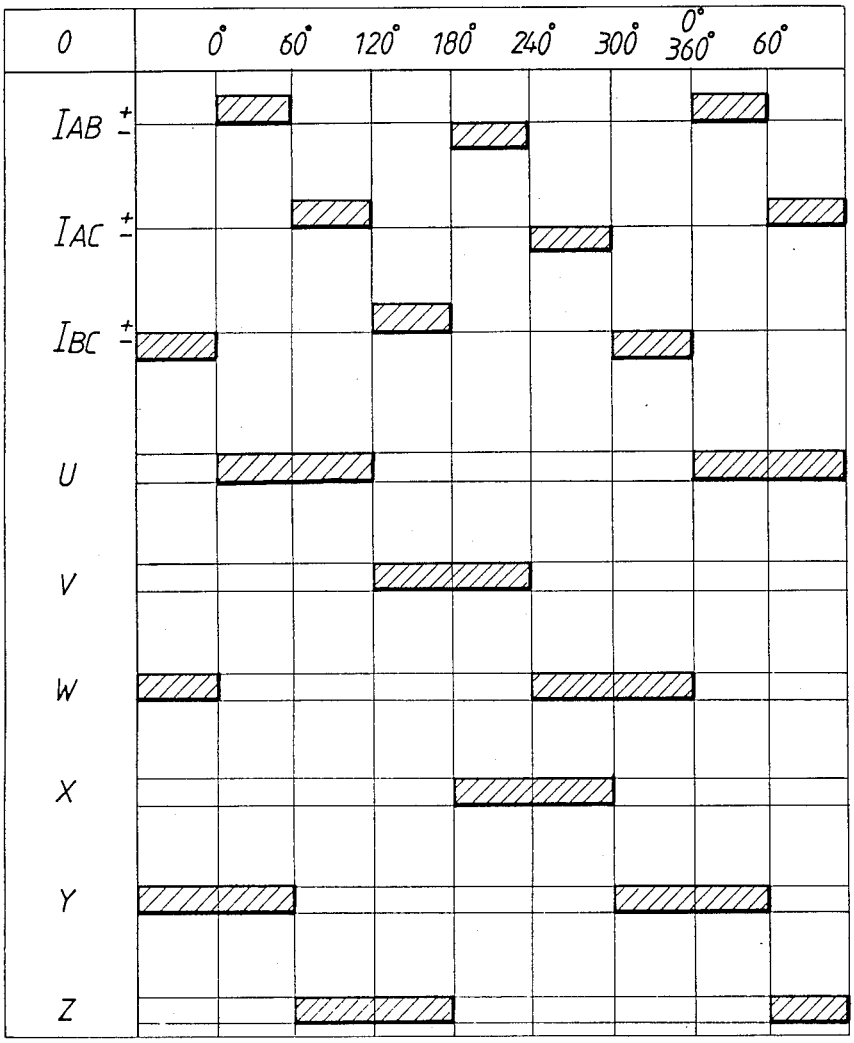
FIG. 5 is the distribution time diagram of current in specific windings of the motor, which produces a forward torque.
Figure 6:
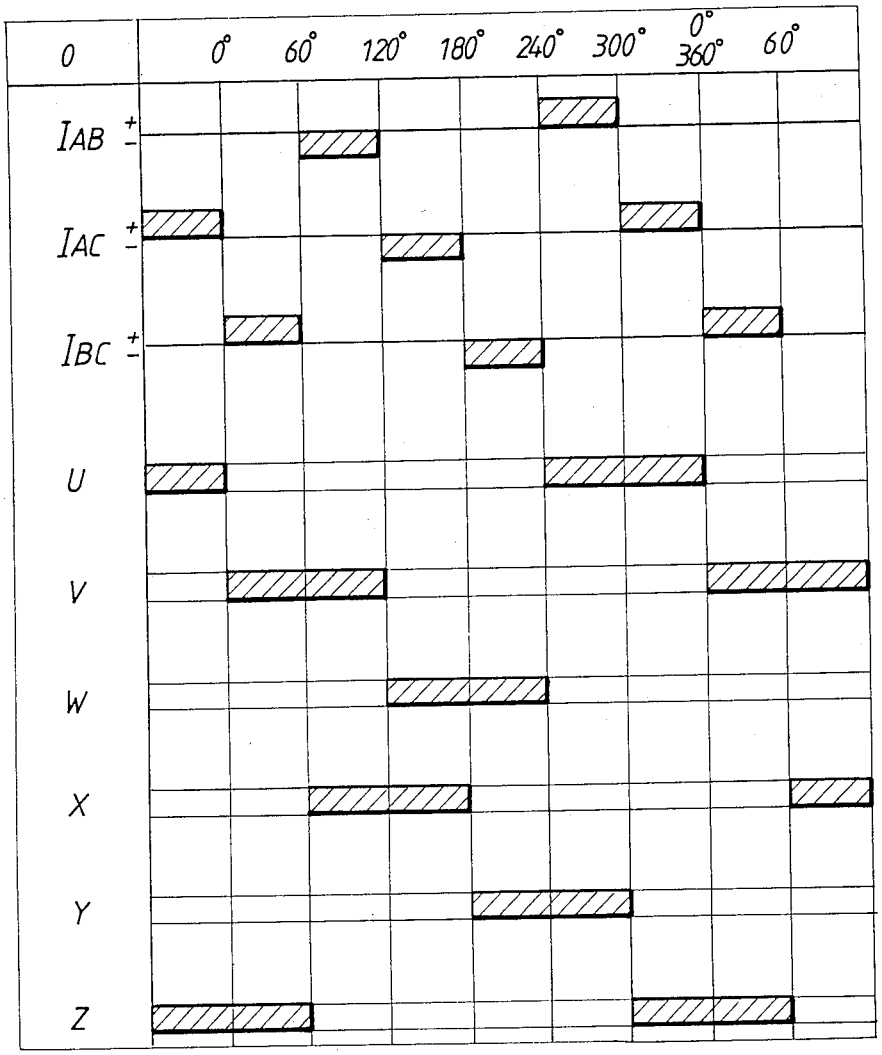
FIG. 6 is the distribution time diagram of current in specific windings of the motor, which produces a backward torque.

Referring to FIGS. 3 and 4, the postion arrangement of the PMRP detector 19B and the variation of three-phase signals S1, S2 and S3 along the circumference are shown. The PMRP detector 19B comprises three photoelectric detectors 46, 47, and 48, which are evenly arranged with 120 degree separated on the circumference of sensor baseboard 19A corresponding to the three stator-windings 13 of the motor, so as to detect the optical encoder disk 49 in accord with the position of the permanent-magnet rotor 14. In FIG. 5, the actuation of specific windings required for generating the forward torque of the motor, and the corresponding time sequence of on or off operation of specific power transistors are shown. The output value of the torque of the motor is still controlled by the PWM 42. The actuation of specific windings required for generating the backward torque of the motor and the corresponding time sequence of on or off operation of specific power transistors are shown in FIG. 6. The backward torque would decelerate the rotation of the rotor shaft of the motor or control the positioned stagnation of the sewing needle. The detailed description of the menthod for controlling the forward and backward torques of the motor is disclosed in chapter 6 of the book "DC Motor, Speed Controls, Servo System" fifth edition, published by Electro-Craft Corporation in 1980.

Figure 7:
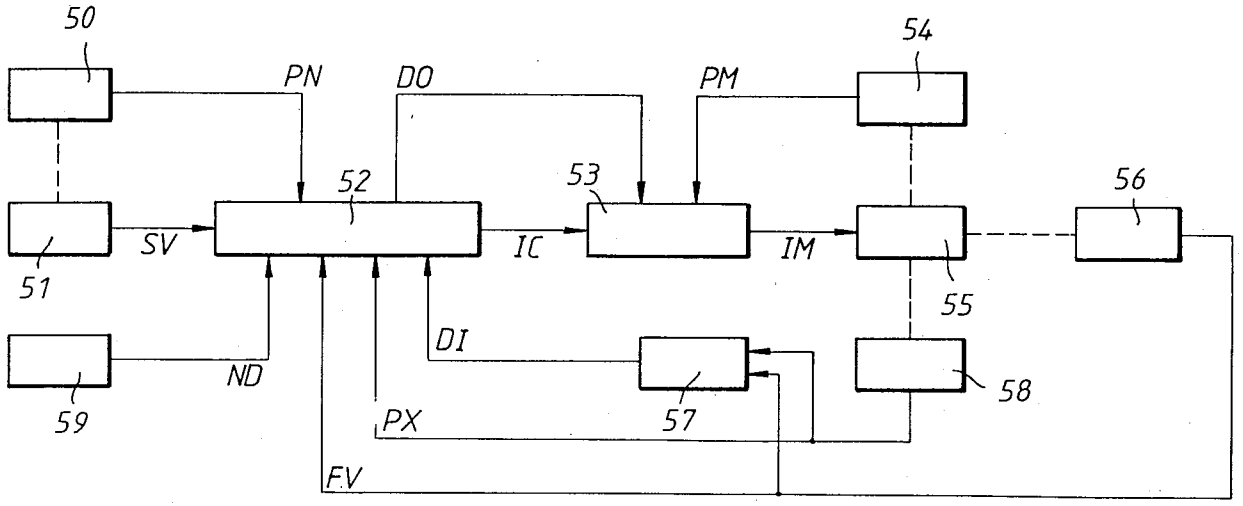
FIG. 7 is the block diagram showing the function of the whole motor control device.

FIG. 7 shows a complete block diagram of the sewing machine motor control device. When the angular displacement of the control pedal 50 is larger than a threshold value, a pedal signal PN with positive value will occur so as to activate the rotational-speed setting apparatus 51 to generate a rotational-speed command SV in proportion with the angular displacement of the control pedal. The micro-processor 52 receives the output signal SV of the rotational-speed and rotational-speed polarity detector 56 and the above-mentioned rotational-speed command SV, and, after comparing and calculating process, obtains the direction command DO and motor current command IC. The control logic and PWM driver 53 receives the updated magnet-pole position signal PM of the rotor via the magnet-pole sensor 54 of the motor and, following the DO command from the mciro-processor 52, introduces current with corresponding order IM to the winding set 55 of the motor. The mean value of the current is adjusted by the PWM. In order to positionedly stagnate the motor, the microprocessor would start to decelerate the motor as it detects the conditon that the pedal-position signal PN is less than the threshold value, until the speed of the motor is lower than a specific positioning cruising speed, then after the needle-positioning signal has been detected and a reverse current starts to be supplied to brake the motor. One of the characteristics of this invention is that there is a specific relationship between the strength of the reverse braking current and the instantaneous speed of the motor at the moment that it starts to be braked. Since the sewing needle should be stagnated at a specific preset position, i.e. positioned stagnation thereof is desirable, so that the control device of the motor driving the sewing needle is provided with a needle-positioning signal detector 59 which will send out a pulse of substantially 45 degree pulse width (it can be varied in accord with the specific design of the optical encoder) only when the needle is at a specific preset position (it can be arranged to be the up-stop, down-stop, or other fixed position). This pulse is the needle-positioning signal ND. The moment that the front edge of the signal ND is starting to climb is just the moment to start the braking operation. Since the positioned stagnation of the needle of the sewing machine is desirable, the micro-processor starts to drive the rotor reversely with a current whose strength directly proportional to the square of the instantaneous rotational speed of the motor at that moment so as to brake the rotor shaft as the initial speed of the motor is already lower than the positioning cruising speed or it is decelerated down to that speed and the needle-positioning signal ND generated from the needle-positioning signal detector 59 has been detected. The rotor will stop being reversed at the moment that the rotation-direction being changed has been detected by the rotation-direction detector 57. Two position signals with 90 degree phase difference, generated by the position detector 58 with comparatively fine optical grid, can serve as the two input signals of the rotation-direction detector 57 with which to detect the exact point of termination of the braking process precisely so as to quickly stagnate the motor and consequently positionedly stagnate the sewing needle.

Figure 8:
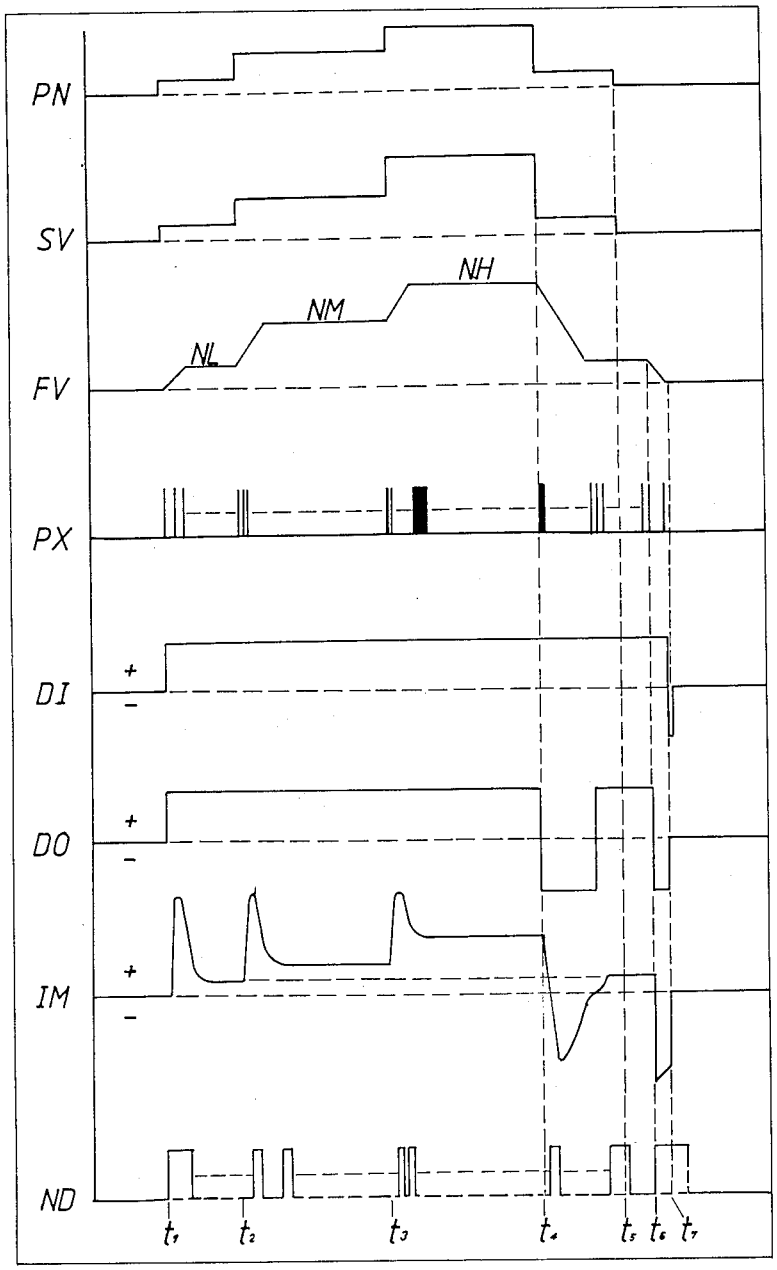
FIG. 8 is the time diagram showing the operation of specific signals shown in FIG. 7.
Figure 9:
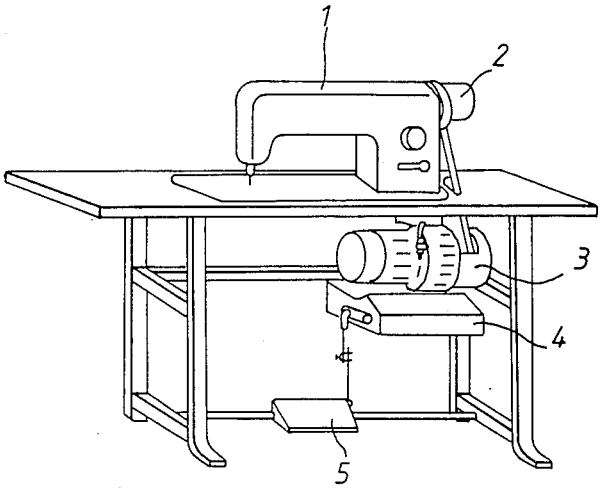
PRIOR ART Fig. 9.
FIG. 9 is a schematic view of the structure of a general electric sewing machine.
Figure 10:
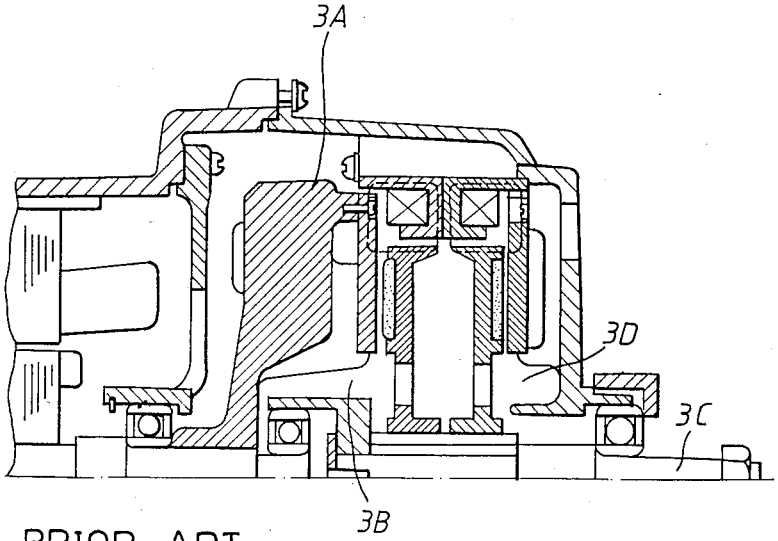
PRIOR ART Fig. 10.
FIG. 10 is a cross-sectional view of partial structure shown in FIG. 9.

In order to more clearly describe the operative sequence of FIG. 7, please refer to FIG. 8 which, in a wave form, shows the variation of signals representing specific blocks shown in FIG. 7. As time equals t1 (t=t1), an initial pedal signal PN from the control pedal of the sewing machine activates the rotational-speed setting apparatus so as to make it set up a dead slow speed NL. Since at that moment the output signal FV of the rotation-speed setting apparatus 56 equals zero, the micro-processor will then sent out the current in accord with the dead slow speed NL. Since the value of FV is zero at t=t1, the motor current IM is extremely large and hence the motor can immediately be started. When motor speed reaches the stable value NL, the motor current is then maintained at a constant value. As time reaches t2, the control pedal is pressed down to its middle position. Accordingly, the motor current increases to another constant value. As time reaches t3, the control pedal is further pressed down to its bottom position corresponding to a high speed NH. Then, the constant value of the motor current is further increased so as to maintain a high speed operation of the sewing machine. During the time period t1 to t4, the rotational speed is kept either constant or gradually rising. The micro-processor will set out the forward torque. The value of DO is positive. At t=t4, velocity setting value SV decreases. In order to quickly decelerate the rotor of the motor, the micro-processor reverses the direction of the motor current so as to produce a large backward torque (negative DO value). When the rotational-speed is decreased to the NL value again, the torque again changes to be forward (positive DO value). Therefore, according to the above-description, the angular displacement of the control pedal can be used to determine the output of the rotational-speed setting apparatus so as to subsequently alter the operation speed of the sewing machine. If the positioned stagnation of the sewing needle is desirable, the control pedal is released at t=t5 as shown in FIG. 8. The micro-processor will simultaneously sense the disappearance of the pedal signal PN and detect the condition that the instantaneous rotational speed of the motor has reduced to be lower than the positioning cruising speed required for the brake operation. Nevertheless, the micro-processor will not supply the reverse braking current to the motor until the needle-positioning signal detector detects the appearance of the next needle-positioning signal ND at t=t6. As soon as the output signal DI of the rotation-direction detector changes from positive value to negative value, the reverse current producing a brake torque is cut off to zero so as to quickly stagnate the sewing needle to a preset position. Since the rotation-direction signal DI is generated via a phase detector whose input are the two output signals of the position detector and have a 90 degree phase difference from each other. So that, change of the undated rotation-direction signal DI can be sensed within half degree of rotation of the motor shaft. Therefore, detecting of said rotation-direction signal can result in precise positioned stagnation of the sewing needle.

The strength of the reverse current for braking the motor has relation to the instantaneous rotational speed W of the motor being starting to be braked. Due to the limitation of the brake-ability of the control means and the requirement of the positioned stagnation, the micro-processor starts to decelerate the sewing machine and reduce the rotational speed thereof to a specific (but adjustable) positioning cruising speed as soon as it detects that the pedal-position signal has been lower than the threshold value. The positioning cruising speed is maintained until the needle-positioning signal has been detected. Then, the reverse driving current, which is determined by the specific manner being going to be described hereinafter, is supplied. Since the dead slow speed in accord with the pedal signal PN reaching the threshold value is still lower than the aforementioned positioning cruising speed, the instantaneous rotational speed of the sewing machine could be any value between the positioning cruising speed and the dead slow speed as the brake operation starts. Therefore, the strength of the reverse current should have a specific functional relationship with the rotational speed of the motor at the moment that it starts to be braked so as to completely stagnate the sewing needle at a fixed angular displacement in various conditions with different rotational speeds of the motor at the moment that it starts to be braked.

By the analysis of rotational dynamics, the initial rotational speed W of the motor at the moment that it starts to be brake, reverse (braking) current I which is invariant throughout the braking process, equivalent rotational inertia J of the motor and the sewing machine, equivalent damping constant r of the load, torque constant K of the motor, and the angular displacement D of the motor shaft from the beginning of the braking process to the complete stagnation thereof would satisfy the following equation:

$$D=JW/r-KIJ/r\cdot Ln\ (1+rW/KI)$$

where Ln denotes the natural logarithm function.

In general case it is quite complicated to find the relationship between I and W at a fixed D. However, in actual conditions, if the rotational speed is the positioning cruising speed which is the upper limit of the rotational speed at which the brake operation starts and a full power reverse braking current is supplied, the ratio of the torque rW of the load and the brake torque KI is approximate 1/5. In fact, the rW corresponding to any W between the positioning cruising speed and the dead slow speed is less than KI. In the condition that the ratio of rW/KI is quite less than 1, the above equation may be approximated such that to expand the natural logarithm function and to keep the terms to the square of the rW/KI, and we can get the following approximate equation:

$$D=JW^2/2KI$$

It can be seen that, from the above equation, only if the ratio of the reverse current I to the square of the instantaneous rotational speed W of the motor at the moment that it starts to be braked is kept constant, the braking distance D may then be maintained as a constant and would not vary with different W. It means that the deviation between the angular position of the sewing needle at the moment that the needle-positioning signal is detected and at the moment that the sewing needle is completely stagnated is kept constant. This constant angular deviation can be corrected with an advanced compensation so as to ideally finish the positioned stagnation of the sewing needle.

If the full power reverse braking current Im is applied as the value of W equals the positioning cruising speed Wm, then the values of I corresponding to various W values, with the value of D fixed, should be:

$$I=(Im/W^2m)\cdot W^2$$

Hence, as the micro-processor 52 detects that the pedal signal PN is less than the threshold value, the rotational speed of the motor is immediately reduced to the positioning cruising speed by the deceleration operation. If the instantaneous rotational speed has been lower than the positioning cruising speed, the microprocessor would maintain that speed and at once start to detect the needle-positioning signal. As the needle-positioning signal is detected, with the output speed signal FV of the rotational-speed and rotational-speed polarity detector 56 at that moment, after some calculations or a looking into table program, the microprocessor 52 outputs a reverse braking current, which is directly in proportional to the square of the rotational speed in accord with the FV signal output from the rotational-speed and rotational-speed polarity detector, with a proportion constant therebetween $Im/W^2m$. It is further noted that even if the strength of the reverse braking current I varies in accordance with the initial speed of the motor shaft at which the brake operation starts as described hereinbefore, the ratio of rW and KI is still pretty lower than 1 in regard to any W value between the positioning cruising speed and the dead slow speed. Accordingly, the above-described approximate analysis is reliable.

In the above-described embodiment, the reverse current producing a brake torque is cut off at the moment that the detected positive value of the rotation-direction signal DI is changed into a negative value. As an another embodiment of the present invention, the alternative method to positionedly stagnate the sewing needle is to be described hereinafter. When the needle-positioning signal ND is detected by the needle-positioning signal detector, the reverse current producing a brake torque is applied to the motor. Until that the polarity of the output signal of the rotational-speed and rotational-speed polarity detector changes, then the reverse current will be immediately cut off. The point on which the rotational speed of the rotor shaft is exactly equal to zero can haradly be precisely detected by conventional detecting methods. Comparatively, the detecting method according to the present invention uses a polarity comparator to precisely detect the very moment that the polarity of the output signal of the rotational-speed and rotational-speed polarity detector changes. The alternative method of positionedly stagnating the sewing machine also applies the specific strength control of the reverse current as described hereinbefore. The polarity comparator comprises an operational amplifier which possesses a pretty high common mode rejection ratio. Thus, the operation of the polarity comparator will not be affected by the DC level drift or the change of the ambient temperature so as to successfully detect the exact changing point of the polarity.

Since the state of complete stagnation of the rotor shaft or the sewing needle can be precisely detected by the control mechanism and methods described hereinbefore according to this invention, the strength of the reverse braking current specifically determined can hence be supplied so as to quickly brake the sewing needle to a stagnant position at a fixed braking distance. The brake torque applied to the rotor shaft is quite large so that the difference between the stagnation position of the sewing needle and the position at which the above-mentioned needle-positioning signal is detected is insignificant (substantially less than 3 degree). Such a minor deviation with substantially constant value can hence be compensated in advance so as to precisely stagnate the sewing needle to a specific preset position. The detections of the changing point of the rotation-direction and the polarity changing point of the detected speed signal are performed by the phase detector and the polarity detector, respectively. Both such detecting methods will not be affected by the DC level drift and the ambient temperature. Furthermore, with the specific strength control of the reverse braking current as described hereinbefore for braking the motor shaft assures that the positioned stagnation of the sewing needle is effectively applicable on various initial speed of the sewing machine.

As various possible embodiments might be made of the above invention without departing from the scope of the invention, it is to be understood that all matter herein described or shown in the accompanying drawings is to be interpreted as illustrative and not in a limiting sense. Thus it will be appreciated that the drawings are exemplary of a preferred embodiment of the invention.

I claim:

1. A motor control device provided on an electric sewing machine for variable speed and needle position stagnation operation, comprises a brushless DC motor having a permanent-magnet rotor, a sewing-machine rotational-speed and polarity detector, a needle-positioning signal detector, a rotor-position detector, a rotor rotation-direction detector, a rotational-speed control means, and a needle-position control means, whereby said control device achieves the variable operation speed and the needle position stagnation of the sewing machine by controlling the mean value and direction of the motor current and further by the operation of said rotational-speed control means and said needle-position control means, characterized in that in a braking process of the sewing machine, the reverse current of the motor is supplied for producing a brake torque as said needle-positioning signal detector detects a specific needle-positioning signal, and that the reverse current producing said brake torque is cut off as the change of the rotational-direction of the rotor is detected by said rotor rotation-direction detector.

2. A motor control device as claimed in claim 1, wherein said rotational-speed and polarity detector generates an output signal whereby the reverse current producing said brake torque is cut off as the polarity of the output signal of said rotational-speed and polarity detector changes from a positive value into a negative value.

3. A motor control device as claimed in claim 2, wherein a polarity detector is provided to detect the polarity change of the output signal from said rotational-speed and polarity detector.

4. A motor control device as claimed in claim 3, wherein said polarity detector is an operational amplifier wherein the input signal of one input terminal is an analog voltage signal generated from said rotational-speed and polarity detector and the input signal of the other input terminal with opposite polarity thereof is a reference DC level.

5. A motor control device as claimed in claim 2, wherein the strength of the reverse current producing the brake torque is directly proportional to the square of the instantaneous rotational-speed of the motor simultaneously at the moment that the needle-positioning signal is detected and the reverse current of the motor is supplied to brake the motor.

6. A motor control device as claimed in claim 5, wherein a proportional constant, between the strength of the reverse current producing the brake torque and the square of the instantaneous rotational speed of the motor at the moment that the needle-positioning signal is detected, equals the ratio of a full power braking current strength to a square of positioning cruising speed of the motor.

7. A motor control device as claimed in claim 1, wherein the strength of the reverse current producing the brake torque is directly proportional to the square of the instantaneous rotational-speed of the motor simultaneously at the moment that the needle-positioning signal is detected and the reverse current of the motor is supplied to brake the motor.

8. A motor control device as claimed in claim 7, wherein a proportional constant, between the strength of the reverse current producing the brake torque and the square of the instantaneous rotational speed of the motor at the moment that the needle-positioning signal is detected, equals the ratio of a full power braking current strength to a square of positioning cruising speed of the motor.

9. A motor control device as claimed in claim 1, wherein said rotor rotation-direction detector further comprises a phase detector which receives two position signals having a 90-degree phase difference from each other from said rotor position detector.

* * * * *